United States Patent [19]

Roveroni

[11] 4,102,276

[45] Jul. 25, 1978

[54] DECORATING OR SHELF SYSTEM

[76] Inventor: Bruno Roveroni, Eisenbahnstrasse 10, D 6079 Sprendlingen, Germany

[21] Appl. No.: 587,835

[22] Filed: Jun. 18, 1975

[30] Foreign Application Priority Data

May 9, 1975 [DE] Fed. Rep. of Germany ..... 2405510
Jun. 18, 1974 [DE] Fed. Rep. of Germany ..... 2429122

[51] Int. Cl.[2] ..... A47F 5/11

[52] U.S. Cl. ..... 108/156; 211/135; 211/149

[58] Field of Search ..... 211/149, 148, 177, 178 R, 211/73, 134, 135; 248/174, 150; 108/111, 156; 312/259

[56] References Cited

U.S. PATENT DOCUMENTS

| | | | |
|---|---|---|---|
| 1,147,975 | 7/1915 | Ruff | 211/177 X |
| 1,442,019 | 1/1923 | Whitesides | 211/149 |
| 1,555,554 | 9/1925 | Cohn | 248/174 |
| 1,654,409 | 12/1927 | Browne | 211/149 UX |
| 2,132,785 | 10/1938 | Hill | 108/111 |
| 2,750,050 | 6/1956 | Ebert | 248/174 X |
| 3,093,247 | 6/1963 | Erickson | 211/149 X |
| 3,176,419 | 4/1965 | Stein | 248/174 X |
| 3,292,796 | 12/1966 | Paige | 248/174 X |
| 3,362,610 | 1/1968 | Van Dyke | 211/135 X |
| 3,877,396 | 4/1975 | Patterson | 211/148 |

FOREIGN PATENT DOCUMENTS

| | | | |
|---|---|---|---|
| 2,038,877 | 2/1972 | Fed. Rep. of Germany | 108/111 |
| 593,560 | 3/1959 | Italy | 211/135 |
| 864,123 | 3/1961 | United Kingdom | 211/148 |

*Primary Examiner*—Roy D. Frazier
*Assistant Examiner*—Robert W. Gibson, Jr.
*Attorney, Agent, or Firm*—Edwin E. Greigg

[57] ABSTRACT

A shelf system having a series of support surfaces which are retained in cooperative, spaced relation by an article constructed from a blank of material which is cut and scored in a predetermined manner so that it may be subsequently folded into the finished product which may be utilized to stabilize an assembly of support columns which in turn are associated with said shelving system.

3 Claims, 31 Drawing Figures

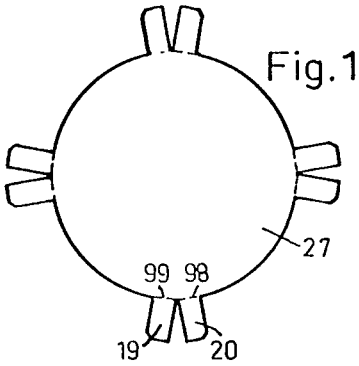
Fig. 19
Fig. 20
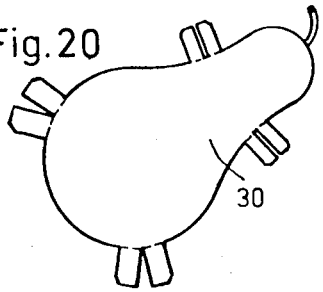
Fig. 21
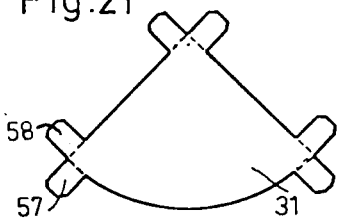
Fig. 24
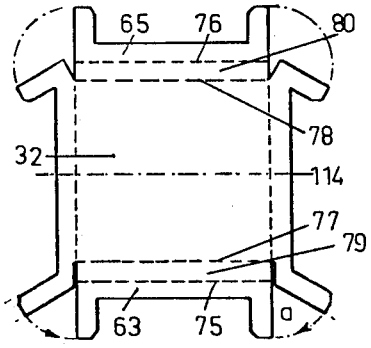
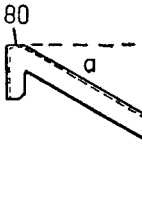
Fig. 25

DECORATING OR SHELF SYSTEM

The invention relates to a decorating or shelf system comprising decks or support surfaces arranged above each other and/or side by side and spacer or brace elements combined with support columns, consisting of a stiff, foldable material such as cardboard, plastic and the like, and of separate flat precut blanks.

A shelf system is already known which contains decks or support surfaces arranged above each other and which is manufactured from hard Polyvinylchloride (PVC) and is known as a "shop system". This shelf system consists of a larger number of components, like connecting elements, cover plates, square tubes and plate supports. The number of the components is further increased by already six various forms of connecting elements being required to permit numerous variations of the assembled system. In addition to the relatively large number of the different components, this shelf system has the further disadvantage that the support elements and connecting elements are formed as hollow bodies which cannot be folded flat so that a considerable space is required for this shelf system in shipping. Furthermore the cost of manufacture of such a shelf system is considerably increased because of the large number of various components.

From the DT-GbmS No. 7,228,365 (German Utility Model) a shelf system is known which consists of a flat precut blank wherein a pillar or column with square base is formed by a gumming (glue joint) at one long edge of this blank, the column being insertable by means of multiple slits at the top and bottom into corresponding cut-outs of a platform. This platform also consists of a flat precut blank which is folded up into a box-like platform with a gumming at only one edge, wherein two opposite smaller sides are provided with insertable tongues. At the four corners of the platform slots are provided into which the tongues of the support columns can be inserted.

A disadvantage of this shelf system consists in that the square or rectangular column must be provided with additional wire bracing since it cannot be made sufficiently stable in itself. Furthermore, there is the disadvantage that also a larger number of components is required.

From DT-OS No. 2,153,603 (German Published Patent Application) a tiered tower for display of goods in shops is known which consists of a plastic material and contains bottom members and spacer supports having the same configuration, which is assembled on site. The connection of the spacer supports with the bottom members is effected by inserting the spacer supports into corresponding recesses (or shafts) of the bottom members, the ends of the support columns being provided with springs which snap into slots provided in the recesses of the bottom members.

Apart from the complicated manufacture of the plastic members, in particular because of the assembly of springs the slots, there is the further disadvantage that the plastic members cannot be folded flat for shipping. The space required for the separate components for shipping is therefore very large and because of this also larger amounts of packing material are required.

The DT-GbmS No. 7,142,355 (German Utility Model) describes spacer supports for a system comprising a stiff foldable material like cardboard, which in each instance are formed out of flat precut blanks.

These spacer supports have the disadvantage that they consist of two parts and do not contain scorings for the formation of a hollow body.

The present invention is based on the objective of providing a decorating or shelf system with a minimum number of precut blanks, which may be manufactured on machines, permitting ready folding for shipping and being very stably formed when it is assembled for use.

In accordance with the invention this objective is solved by providing in a decorating or shelf system of the above type support columns as well as spacer and brace elements consisting of a flat element with fold lines and/or scorings extending in transverse and/or diagonal and/or longitudinal direction in which the area sections formed by these fold lines and/or scorings represent exterior and support surfaces of a hollow body or a body having an angular cross section which is adapted for insertion by at least one tongue (flap) and/or one slot of one or more support surfaces, spacer elements or brace elements or an additional support column for obtaining a stable connection with these elements.

The exterior area sections of the support column formed by said fold lines comprise at least one slot each which is approximately orthogonal to the longitudinally extending fold lines extending at the same height such, that the outer area sections are mutually insertable so that a support column with angular cross section is obtained.

In a further embodiment of the invention an outer area section of a support column formed by a fold line comprises a scoring which extends orthogonally to this fold line and defines an area portion (section) having an edge forming an a angle of approximately 45° with the fold line and having an area portion shaped as an insertable tongue (flap), wherein in the assembled form the support column represents a triangle in cross section which has the edge of this area portion as a base, the area of the triangle being formed by said area portion.

This configuration of the support column can be joined in a simple manner by insertion to form a body which is stable with respect to buckling and having a cross section which for example is triangular.

In a further embodiment of the invention, the two adjacent area portions formed by two parallel fold lines each comprise a scoring which forms an angle of approximately 45° with the longitudinally extending fold lines and form an angle of approximately 90° with each other in an uninterrupted line, wherein the upper edges of these area sections (portions) together with the scorings define a four-cornered area such that in the assembled state of the support column the upper edges of these area sections lie in a plane forming a right angle with the support column and the area sections extend funnel-like to the support column. These funnel-shaped area sections serve as a support for a support surface wherein a maximum of this surface may be utilized since the cross section of the support column forms an angle of 90°.

At least the outer area sections of the support column formed by folding lines or scorings are joined in such a manner that interior surface lies on interior surface or interior surface on outer surface or outer surface lies on outer surface so that a hollow body or an angle is obtained the legs of which consist of at least two area sections. The outer area sections of the support column formed by fold lines or scorings in accordance with the invention have a smaller longitudinal extent than the central area sections enclosed by them so that the area portions of the inner area sections which project over the outer area sections are formed as outwardly and/or downwardly extending insertable tongues which have approximately the same length and width as the length and width of the tongues of the support surfaces, spacer elements or brace elements.

In a modified embodiment of the invention the spacing of the longitudinally extending outer fold lines or scorings of the support column from the respective outer edge of the area element is equal to or smaller than the spaciang of the succeeding fold line from said fold line and this distance again is smaller than the spacing of the next succeeding from its preceding fold line. In this embodiment of the support column again an extended utilization of the support area is possible without adversely affecting the stability of the support column with respect to buckling.

In a further embodiment of the invention the spacing of one outer longitudinally extending fold line of the support column is smaller than the spacing of the other outer longitudinally extending fold line. With this embodiment of the support column an area portion is formed by means of the smaller spacing of the longitudinally extending folding line which serves as a glue joint.

In accordance with the invention it is furthermore proposed for the purpose of increasing the bending and buckling stability of the support column to attach a wire or rod-like bracing along at least one fold line or scoring of the area element of the support column. Attaching of such a bracing can take place whether already during manufacture of the blank of the support column or when the support column is folded together by the user.

In accordance with the invention for the purpose of joining an edging (edge bracing) of a support surface at least one slot is formed along one longitudinal fold line or scoring of the area element of the support column proceding from the upper or lower border of the area having a depth corresponding to the height of an edging of the support surface.

In accordance with the invention the support surfaces or decks comprise an edging of arbitrary shape from which insertable tongues project with approximately equal spacing so that these can be connected with the support columns in a simple manner. In a further embodiment of the invention a fold line or scoring is provided between one insertable tongue and the support surface connected with it, so that the insertable tongues can be inserted into a support column forming an angle with the support surface.

In accordance with one embodiment of the invention the support surface has a circular edging and consists of a double layered corrugated paper with corrugations which are orthogonal to each other. From this an increased stability and load-carrying capability of the support surface results.

In a further embodiment of the invention the support surface comprises a plate of foam material which is coated on both sides.

For manufacture of for example a round column, the support surface has an associated shell surface orthogonal to it which along its lower periphery is provided with insertable tongues with the same spacing as in the support surface which are each insertable into a support column together with the corresponding insertable tongue of the support surface. The support surface can also have the shape of a circular segment having two insertable tongues at is corners which form a right angle with each other when they are bent through a right angle to the support surface.

In accordance with a further variation of the invention the support surface is provided with rectangular foldlines or scorings defining edge bracings from which insertable tongues project forming a right angle with the periphery of two opposite edge bracings and at the other two opposite edge bracings form an angle a equal or smaller to 90°, wherein the angle a in the assembled system represents the angle of inclination of the support surface to the horizontal. Thus, shelf systems with inclined support surfaces may be produced which for example can be used for the display of literature.

In a further variation of this embodiment fold-lines or scorings extend parallel to the fold lines or scorings of the angular and preferably rectangular support surface and define edge bracings, from which insertable tongues project at a right angle and the spacing of this additional fold line is such that in the assembled system a horizontal strip joins the support surface which is inclined to the horizontal and said strip is bordered by right angled bracings.

For special applications the circular or rectangular support surface is provided with a cut-out for taking up a plastic funnel, a bag, a cylinder or a cone which may consist of paper, paper-board or plastic. The support surface which for example is intended to hold loose material in accordance with the invention can also have a box-like shape with tongues for insertion into the suppot columns.

In accordance with the invention a cone-shaped funnel may be realized by having a support surface in the shape of a not closed polygonal having two fold-lines or scorings extending parallel to an outer rim and being bordered by edge bracings, from which insertable tongues project. In these additional radially extending fold-lines or scorings proceding from the corner points are provided so that an upward or downward directed pyramid is obtained in the assembled state.

In order to make a support surface shaped as a triangle, a rectangle or a polygonal useful for supports having side-members forming an angle of 90° in accordance with the invention insertable tongues set-off from the support surface by fold-lines or scorings are arranged in such a way that in each case two tongues located at one corner of a support surface form a right angle with each other when inserted. For this at least those insertable tongues located at the corners of a support surface with an angle different from 90° are adapted to be folded with respect to the bracing connected with them by means of a fold-line or scoring along the longitudinal axis of the tongue where the base line of each tongue is separated from the support surface by an incision. In this manner two tongues may form an angle of 90° in the folded state, although the associated corner of the surface has an angle different from 90°.

For manufacture of vertically disposed surfaces supported by support columns or for spacer elements these comprise two areas separated by fold-lines or scorings and a bracing member with insertable tongues is located between two fold-lines separating the areas and two fold-lines bordering an area wherein at each outer end of a bracing member two insertable tongues are provided, having base lines which form a right angle.

In a variation of this embodiment a spacer and/or brace element consists of at least two areas separated by fold-lines or scorings and at least one area element is provided with insertable tongues at its transverse sides wherein at least one surface portion is provided with cut-outs for insertion of mounting (connecting) members.

In a further embodiment of a spacer element the area portions are provided with transverse sides having different lengths and being alternately straight or angled so that in the folded state a rigid side member with an angled edge (border) is obtained.

In order to be able to fold together a shelf system in accordance with the present invention without separating the support columns from the support surfaces the support surfaces are provided with fold-lines or scorings for carrying-out such a folding operation. One of said scorings extends along the center line including the adjoining bracing members and an additional folding line is parallel to the above fold-line and extends along one side-edge and an insertable tongue and a further fold-line proceeds from the fold-line orthogonal to the center fold-line and defines an insertable tongue extending diagonally across a bracing member to an outer edge.

In a further modified embodiment the support surfaces are supplied with holes for taking up box-like parts.

A more detailed description of the invention is given in the form of different embodiments in connection with the drawings, which show:

FIG. 1 a plane view of a support column in the form of a flat pre-cut blank, FIG. 2 a perspective view of the support column of FIG. 1 in the folded state, FIG. 3 a plane view of a further embodiment of a support column in the form of a flat pre-cut blank, FIG. 4 a perspective drawing of a support column of FIG. 3 in the folded state.

FIG. 5 a perspective view of a support column with insertable tongues at the upper and lower long edge, FIG. 6 a perspective view of a support column with upper insertable tongues and slots for insertion of a support surface edging, FIG. 7 a support column without insertable tongues, FIG. 8 a plane view of a pre-cut blank of a support surface, FIG. 9 a side-view of a support surface of FIG. 8 in which the side bracing members are already folded through 90°, FIG. 10 a plane view of a pre-cut blank of a support column, FIGS. 11–18 perspective views of different embodiments of support columns with insertable tongues, FIG. 19 a plane view of a circular support surface, FIG. 20 a plane view of a pear-shaped support surface, FIG. 21 a support in the form of a circular segment, FIG. 22 an assembled shelf system in side-view with different support surfaces, FIG. 23 the illustration of FIG. 22 turned through a right angle with inclined support surfaces, FIG. 24 a plane view of a support surface for inclined arrangement in a shelf system, FIG. 25 a schematic illustration of the folded support surface of FIG. 24, FIGS. 26, 26*a* an assembled tower or column with a different storage element for storing loose material, FIG. 27 a plane view of a pyramid funnel in its flat folded state, FIGS. 28*a*, 28*b*, 28*c* a side-view of a foldable tiered tower in three phases of the folding operation.

FIG. 1 shows a support column in plane view in the form of a flat pre-cut blank which is provided with longitudinally extending fold lines 1, 2, 3 and 4 wherein the area sections 11, 12, 13 and 14 and 15 formed by these scorings represent outer and support surfaces of the hollow body pictured in FIG. 2. Slots 41, 42, 43 and 44 are provided at the same height level and are orthogonal to the fold lines 1 to 4 so that in the manufacture of a hollow body the resultant area portions of the outer area sections can be interlocked by insertion in a manner as can be seen from FIG. 2. By reason of this configuration of the support column according to FIGS. 1 and 2 no glue-joint of the outer surfaces 11 and 15 is required. A further fold-line or scoring 5 is orthogonal to the fold-line 4 and separates an area element 14 with a tongue 45 from area section 15 having an edge 6 forming an angle of 45° to fold-line 4. In the assemble state the tongue 45 is abutting the area section 13 and the edge 6 forms the connecting line of the legs of a triangle resulting from the area sections 13 and 14. In this the area portion 16 serves for stabilizing the legs of the triangle (in plane view) formed by the area sections 13 and 14. Thereby a support column of high stability against buckling is formed without a glue joint of any area portions being necessary and wherein the area portion 16 serve as supports for the corners of the support surfaces.

The FIGS. 3 and 4 show a further embodiment of a support column with corresponding longitudinally extending fold-lines 1, 2, 3 and 4 by which the area portions 11, 12, 13, 14 and 15 are bordered.

Adjacent area sections 14 and 15 are bordered by two parallel fold-lines 3 and 4, each of said sections having a scoring 7 and 8 forming an angle of 45° with the longitudinally extending fold-lines 3 and 4, wherein these fold-lines 7 and 8 form an angle of approximately 90° with each other in a uninterrupted line. The upper edges 46 and 47 of the area sections 14 and 15 together with the fold lines respectively scorings 7 and 8 define a rectangular area. In folding the support column in accordance with FIG. 3 the area sections 17 and 18 form a cone or funnel as can be seen from FIG. 4 which shows the support column of FIG. 3 in the folded state in perspective view. The upper edges 46 and 47 of the area sections 17 and 18 in this are in one plane so that these serve as a support surface for the deck or support surface which is inserted in the support column which is shaped in this manner. In this embodiment it is of particular advantage that the useful area of the support surface is substantially not affected by the support column, since the support column in the region of the support surface viewed in cross section is shaped as a triangle where the legs are formed by the area sections 13 and 14, as well as 12 and 15 in connection with the area section 11. As shown in the FIGS. 1–4 the area sections 13 and 14 are longer than the adjoining area sections 11, 12 and 15 so that insertable tongues 48 and 49 are obtained which have the same length and width as the tongues 19 to 24 of the different support surfaces, spacer elements and brace elements.

FIG. 5 shows a support column which is provided with insertable tongues 48 and 49 at its upper as well as its lower end. As is clearly shown in this perspective view in this embodiment the outer area sections are glued with their outer surfaces adjoining so that a stiffening of the support column results. The width of the outer area sections is selected so that an approximately unilateral triangle in cross section results in connection with the other width of the area sections which has an extremely high stability against buckling.

In FIG. 6 a further embodiment of the support column is shown in perspective view and is provided with insertable tongues 48 and 49. Two slots 50 and 51 are provided along two longitudinally extending fold-lines of the area element of the support column proceeding from the upper edge of the surface of a support surface where said slots have a depth corresponding to the height of the border or edging of the support surface.

FIG. 7 shows a perspective view of a support column having no insertable tongues and which therefore serves for connection of support columns which are provided at the upper or lower or both ends with insertable tongues 48 and 49. Such elements serve as an extension of the support column.

As can be seen from FIG. 8, a deck or support surface 22' consists of a flat precut blank 26' which is provided with a scoring spaced from and extending along its outer periphery. The bracing members 28' developed by this may be folded through a right angle along the scorings or folding edges so that a surface 22' develops which is enclosed by braces (crosspieces) 28' on all sides, as can be seen from FIG. 9. Each brace contains extensions which are shaped as tongues 14', 15', 16', 17', 18', 19', 20', and 21'. In the folded state each tongue of one brace in plane view forms a right angle with the proximate tongue of an adjacent brace.

The stability of the surfaces 22' with respect to their load-carrying capacity is considerably increased by the right angle folding of the braces 28' along the scorings 27'. Thus the height of the braces 28' can be advantageously adapted to the loading to be expected. Thus, it is also possible to reduce the height of the braces 28' to zero.

FIG. 10 shows a flat precut blank 2' from which a hollow body is folded serving as a support or spacer column. The surface element 2' in the embodiment shown here is provided with five longitudinal scorings 3', 4', 5', 6', and 7', so that surface element (area) sections 8', 9', 10', 11', 12', and 13' are developed. The surface element sections 10' and 11' contain tongues 24' and 25' at their upper ends having the same shape i.e. height and width, as the tongues 14' to 21' of the decks or support surfaces 22'. Slots 29' and 30' are formed between the surface sections 9' and 10' as well as 11' and 12' which extend from the ends opposite the tongues 24' and 25' and extending along the extension of the side edges of the tongues 24' and 25' and the scorings 4 and 6, wherein the length of the slots 29' and 30' corresponds to the height of the braces 28' of the decks or support surfaces 22'.

The FIGS. 11 thru 18 show perspective drawings of different embodiments of support columns with insertable tongues. FIG. 11 shows a support column in which the area sections with which the insertable tongues 48, 49 are integrally connected, form a right angle. The area sections 11 and 15 which are glued together with abutting surfaces have a smaller width than the remaining surface sections. Through this the surface sections 12 and 14 form an angle larger than 90° with each other so that the area taken up by the support column on the support surface is relatively small. The upper edges of the area sections 11, 12, 14 and 15 are in one plane and the support surface which is to be connected rests on this plane.

In FIG. 12 a further embodiment of a support column is shown in perspective. In this the area sections 11 and 15 are glued together in such a manner that the inner side of the area section 15 lies on the outer side of the area section 11. The cross section of the support column resulting from this is similar to the cross section according to FIG. 11.

FIG. 13 shows a further embodiment of a support column in which the area sections 11 and 15 are glued together with their inner sides while the adjoining area sections 12 respectively 14 are in mutual contact with the area sections having the insertable tongues 48 and 49. The support column according to FIG. 13 consists of altogether 6 area sections which in the cross section form a V-shape where an angle bisector proceeds from the intersection of the legs and forms a support surface.

Figure 1:
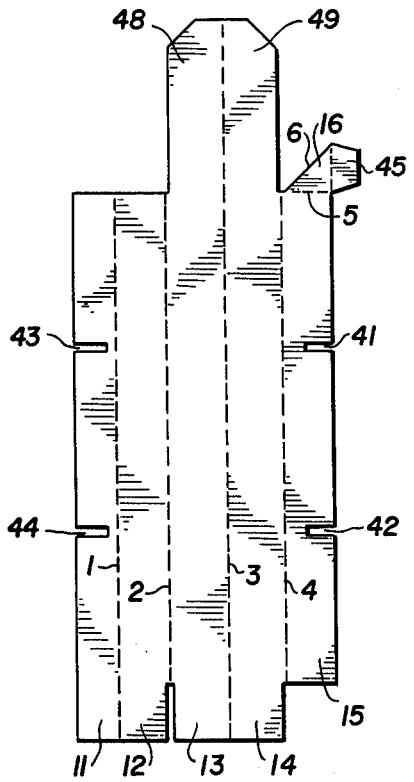
Figure 2:
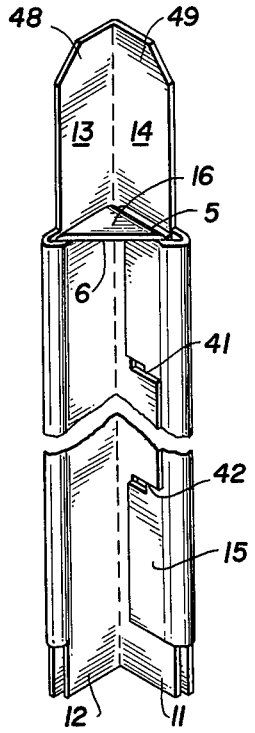
Figure 3:
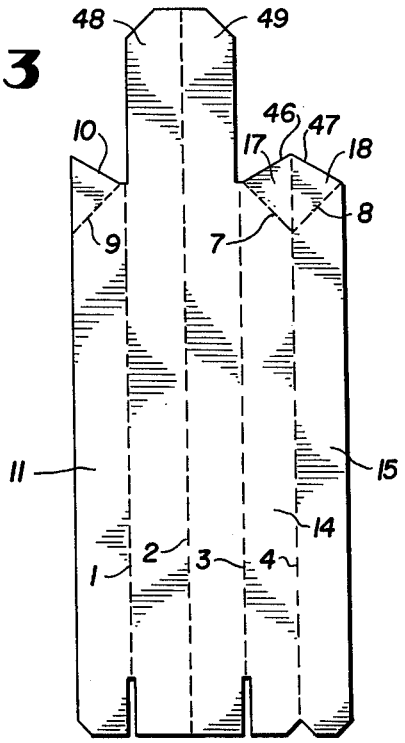
Figure 4:
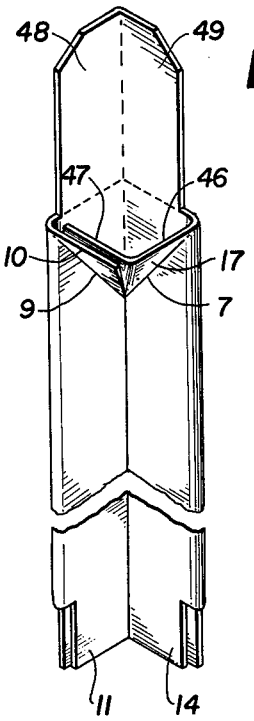
Figure 5:
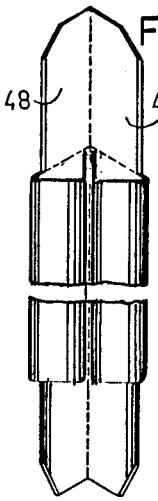
Figure 6:
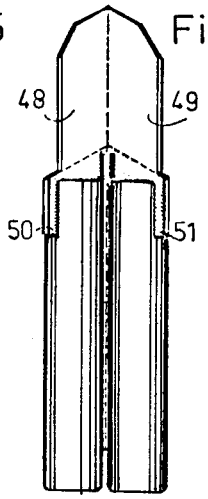
Figure 7:
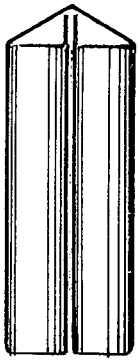
Figure 8:
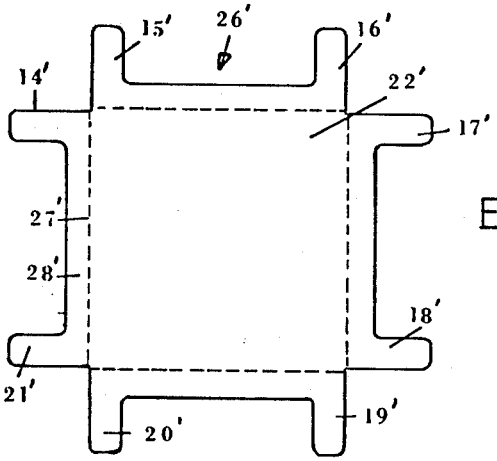
Figure 10:
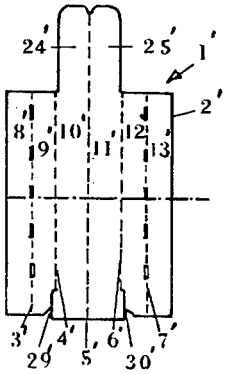
Figure 9:
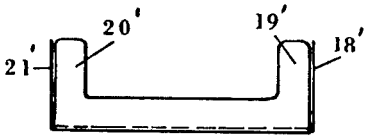
Figure 11:
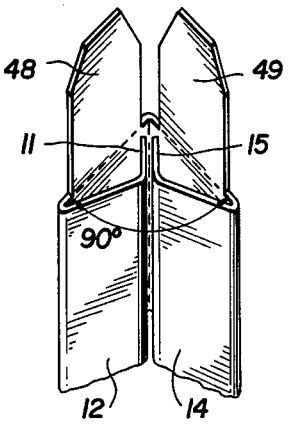
Figure 12:
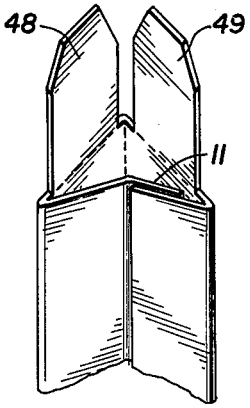
Figure 13:
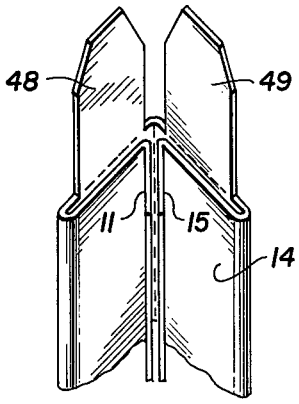
Figure 14:
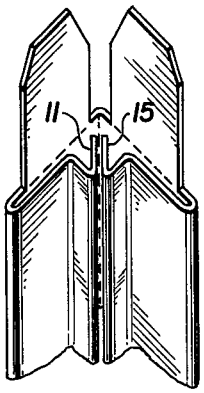
FIG. 14 shows a perspective drawing of a further embodiment of a support column in which the outer surface sections 11 and 15 each have two oppositely foldable fold-lines so that an extremely large stability against buckling is achieved where only a relatively small area portion of the associated support surface is taken up.
Figure 15:
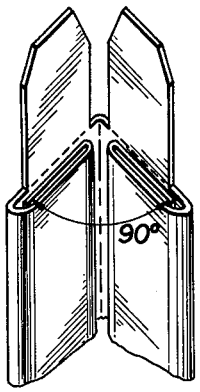
FIG. 15 shows a further embodiment of a support column in which the three outer area sections are folded in the same direction and glued together. In the cross section a V-shape is formed the legs of which consist of three-layered surfaces.
Figure 16:
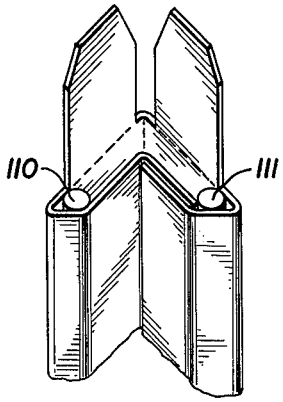

FIG. 16 shows a support column in which for strengthening against buckling metall rods or wires are disposed along a respective fold-line. In this embodiment the precut blank remains relatively flat and the joining of the rods or wires with the pre-cut blank may take place directly after manufacture of the pre-cut blank. The rods or wires are then preferably joined by glue or cement with the pre-cut blank.

Figure 17:
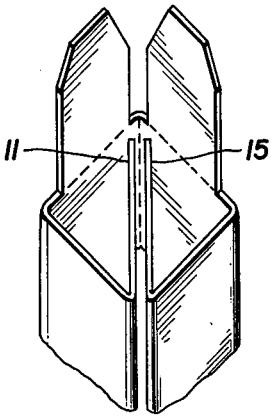

In FIG. 17 a portion of a support column is shown in perspective view in which the fold-lines have an approximately equal spacing so that in cross section a square shape of the support column results with a diagonal, which comprises the two outer area sections 11 and 15.

Figure 18:
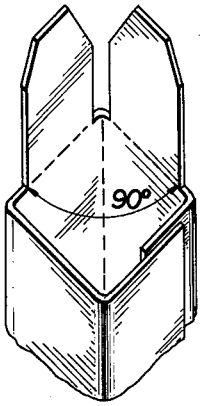

FIG. 18 shows a modification of this embodiment having five area sections wherein the one outer area section has a smaller width than the other. In this embodiment no diagonal transverse brace is provided. Such a support column can also be used where no extremely high stability against buckling is required.

FIG. 19 shows a plane view of a circular support surface serving as a basic element for example for manufacture of a round tower. The base lines 98 and 99 of the insertable tongues 19 and 20 are each a secant of the periphery of the support surface 27 whereby each pair of tongues in the pre-cut blank forms an angle and in the folded state forms an angled line. A support column is used for this embodiment in which the base line also has an angle.

Basically the support surfaces can have any form. FIG. 20 for example shows a pear-shaped support surface 30 which has insertable tongues spaced along the periphery. With this embodiment advertising related to the goods can be carried out. The support surfaces for example can also have a shape of a bottle and can be disposed inclined within a support frame as explained below.

FIG. 21 shows a support surface in form of a segment of a circle wherein perpendicular enclosing walls may be inserted at the radially extending straight sides of the segment surface 31. A sector-shaped tower of decks or tiers in a total assembly can for example serve to connect a number of towers or shelf systems arranged side by side in a right angle to each other. Also right angled walls can be filled with a sector-like device.

Figure 22:
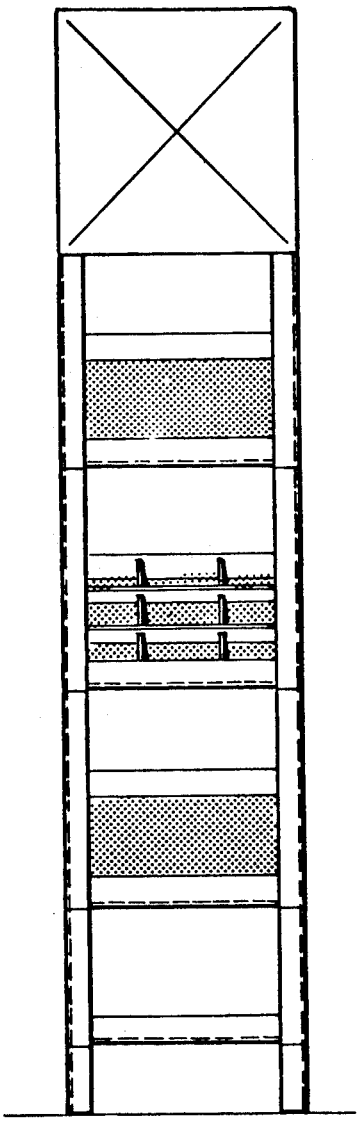
Figure 23:
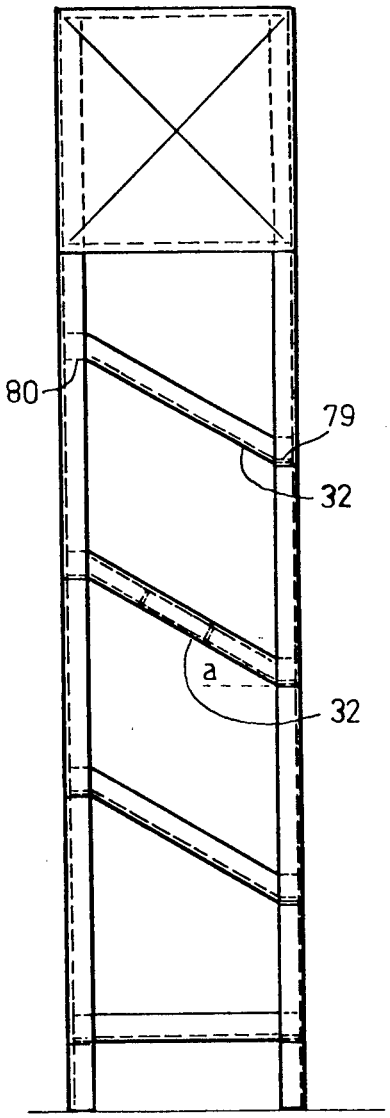

The FIGS. 22 and 23 show assembled shelf systems in a side view (FIG. 22) and in a position turned through 90° with respect to this (FIG. 23). The assembled tower of shelves is provided with support surfaces 32 inclined to the horizontal which are explained in detail with reference to FIGS. 24 and 25. Fold-lines 77 and 78 are parallel to the fold-lines 75 and 76 of the right angled support surface 32 of this embodiment and form horizontal strips 79 and 80 which are joined to vertical bracing members 63 and 64 in the assembled state. The horizontal strips 79 and 80 have a width which corresponds to the dimension of a cross section of a support column. Since the insertable tongues of the support surface 32 must be disposed vertically in the assembled state, it is necessary to shape the pre-cut blank accordingly.

Figure 26:
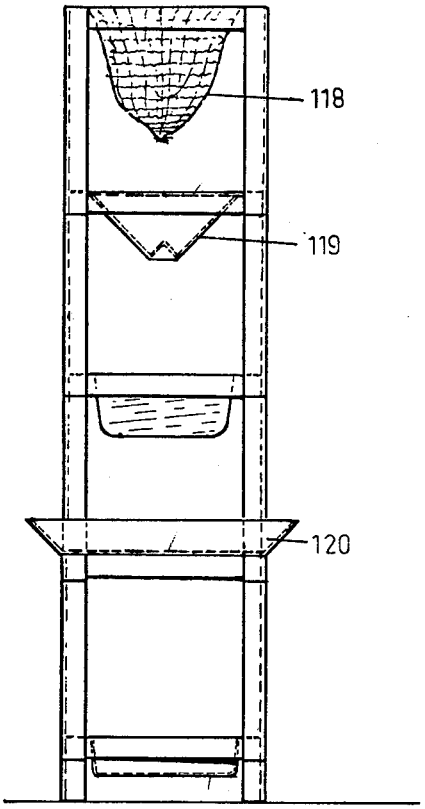
Figure 26A:
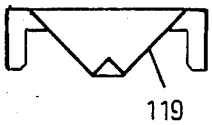

A further embodiment of an assembled tower with different forms of support elements is shown in FIGS. 26 and 26*a*. This tower serves for disposal of loose goods. A support surface 81 with a cut-out 82 in this can serve for taking a net 118 in a further tier or deck for example a cone-like funnel 119 may be disposed in the cutout which has an opening in its peak. In a further embodiment of this shelf tower bracing members 120 may be attached outside of the support columns and inclined to the columns, which are provided with edges supplied with means for a glue joint for four insertions. In this manner the support surfaces may be extensively expanded with respect to their capacity of holding loose materials.

Figure 27:
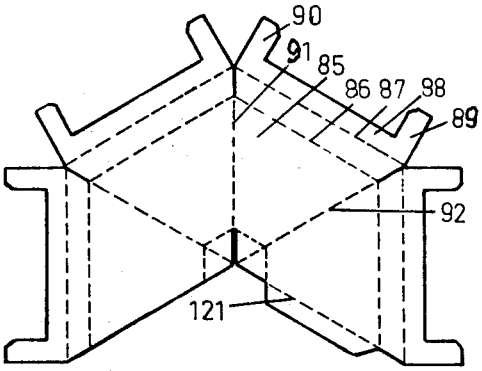

FIG. 27 shows a plane view of a pyramid-shaped funnel in the flat state. The support surface 85 in this is formed as a not closed polygon which has two fold-lines 86 and 87 parallel to an outer edge which are bordered by edge bracing members 88. Insertable tongues 89 and 90 project from these bracing members and radial fold-lines 91 and 92 extend from the edges so that an upward or downward directed pyramid results in the assembled state. In the assembled state the polygon is glued together with the glue-joint area 121.

Figure 28A:
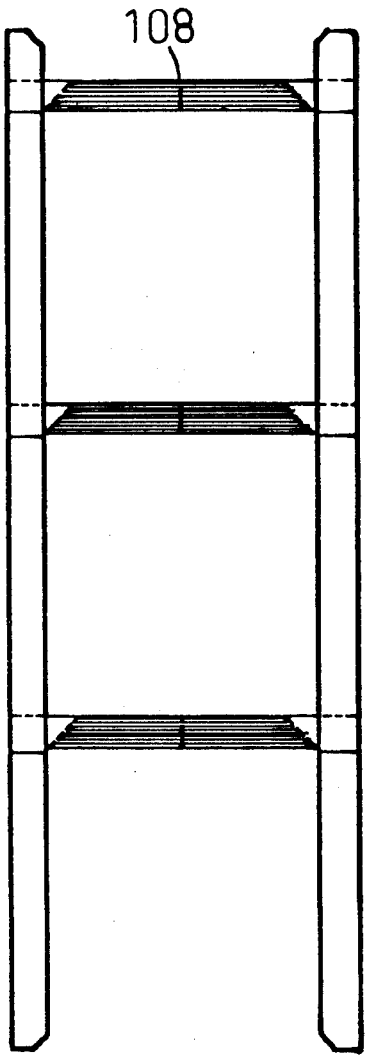
Figure 28B:
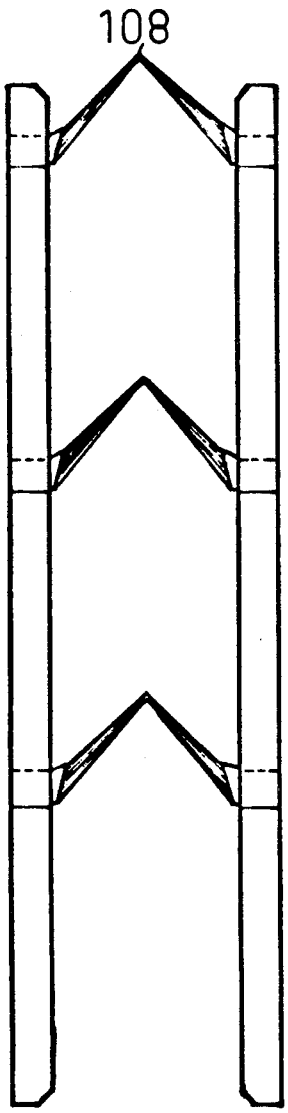
Figure 28C:
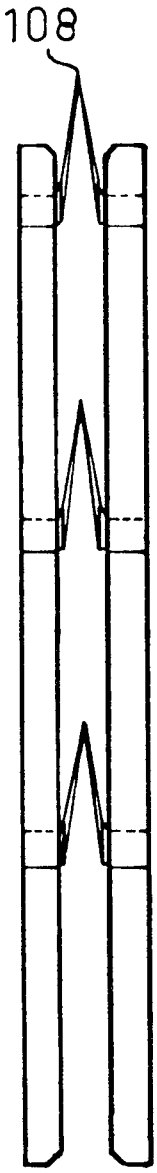

The shelf system according to the invention can also be supplied in a prefabricated state, i.e. in a partly assembled state. For this advantageously the whole system is implemented in a foldable form. Such an embodiment is shown in FIGS. 28*a*, 28*b*, and 28*c* in which three different phases of the folding operation are depicted. The left figure shows a tiered tower or shelf in an unfolded directed state. The central figure shows a phase of the folding operation in which all support surfaces show a folding along a center line 108. The right figure shows the totally folded-up tiered shelf. In order to make it possible to fold together a whole tiered shelf in such a manner, it is however necessary to provide the support surfaces with further fold lines. For carrying-out such folding, the support surfaces are, therefore, provided with fold-lines one of which extends along the center line of each support surface including the adjoining bracing members. One additional fold-line extends parallel to the above fold line along a side edge of an insertable tongue and a further fold-line is orthogonal to the central fold-line and borders an insertable tongue and extends diagonally across a bracing member to its outer limit. By providing this fold-line extending diagonally across a bracing member, such bracing member which is orthogonal to the support surface in the unfolded state folds into a final position so that it lies parallel to the support surface in said final fully folded position, during such folding operation thus the folding along the center line of the support surface is fully effective, so that the complete shelfsystem can be folded extremely flat in its assembled state. By means of the additional fold-line extending along the side edge of an insertable tongue the system can remain in the assembled state.

With the present invention a decorating or shelf system is proposed which consists of only a few basic elements which may each be manufactured from a single pre-cut blank. According to specific requirements extensive possibilities of various systems can be realized in a simple manner.

I claim:

1. A foldable blank for forming a column element for a knock down shelf or display system of the type having upright columns supporting a plurality of shelves therebetween comprising:

an elongated substantially rectangular flat blank having a plurality of parallel score lines extending longitudinally of said blank and defining a plurality of rectangular panel portions thereof, said blank being foldable on said score lines to form a column having two sides extending at right angles to each other, each side comprising at least two of said panel portions folded flat against each other, and at least one panel portion having a score line at an angle to said parallel score lines defining a further panel portion foldable to extend between said two sides and forming a shelf supporting surface integral with said column.

2. A blank as defined by claim 1 in which the two outermost of said panel portions include notches which permit interlocking of said portions in the final position of the blank to eliminate the necessity for gluing.

3. A knock down shelf or display system comprising four columns as defined by claim 1 each positioned at the corner of at least one shelf member supported thereby.

* * * * *